US011643840B2

(12) United States Patent
Damneun

(10) Patent No.: US 11,643,840 B2
(45) Date of Patent: May 9, 2023

(54) APPARATUS, METHOD, AND ASSEMBLY FOR ATTENUATING VIBRATIONS BETWEEN A LATCH AND A STRIKER

(71) Applicant: The Boeing Company, Chicago, IL (US)

(72) Inventor: Char Damneun, Olympia, WA (US)

(73) Assignee: The Boeing Company, Chicago, IL (US)

( * ) Notice: Subject to any disclaimer, the term of this patent is extended or adjusted under 35 U.S.C. 154(b) by 602 days.

(21) Appl. No.: 16/598,030

(22) Filed: Oct. 10, 2019

(65) Prior Publication Data

US 2021/0108443 A1 Apr. 15, 2021

(51) Int. Cl.

| | |
|---|---|
| ***E05B 15/00*** | (2006.01) |
| ***E05B 15/16*** | (2006.01) |
| ***E05B 77/38*** | (2014.01) |

(52) U.S. Cl.

CPC ..... *E05B 15/0006* (2013.01); *E05B 15/16* (2013.01); *E05B 77/38* (2013.01); *E05Y 2900/502* (2013.01); *E05Y 2900/538* (2013.01); *E05Y 2900/548* (2013.01); *E05Y 2900/608* (2013.01); *Y10T 292/68* (2015.04); *Y10T 292/688* (2015.04); *Y10T 292/696* (2015.04); *Y10T 292/705* (2015.04)

(58) Field of Classification Search

CPC .... Y10S 292/56; Y10S 292/73; Y10S 292/60; Y10T 292/03; Y10T 292/68; Y10T 292/683; Y10T 292/685; Y10T 292/688; Y10T 292/691; Y10T 292/694; Y10T 292/696; Y10T 292/699; Y10T 292/702; Y10T 292/705; Y10T 292/707; E05B 15/006; E05B 15/16; E05B 77/38; E05B 15/0006; E05Y 2900/538; E05Y 2900/548; E05Y 2900/608; E05Y 2900/502

See application file for complete search history.

(56) References Cited

U.S. PATENT DOCUMENTS 5,314,280 A * 5/1994 Gagliardi ..... B62D 27/026 411/258
5,335,396 A * 8/1994 Dolan ..... E05C 17/30 292/262

(Continued)

*Primary Examiner* — Christine M Mills
*Assistant Examiner* — Faria F Ahmad
(74) *Attorney, Agent, or Firm* — Quinn IP Law

(57) ABSTRACT

A vibration-reducing apparatus for an assembly comprising a first member including a latch and a second member including a striker may include a threaded post having arm members extending outwardly therefrom, the threaded post being rotatably advanceable in discrete increments in a threaded opening extending through the first member such that, in a closed position of the first and second members, a distal portion of the threaded post extending through the first member contacts the second member upon rotational advancement of the threaded post in the threaded opening; and a locking region arranged to interact with at least a portion of the arm members, the rotational advancement of the threaded post in the threaded opening and contact with the second member reducing an engagement distance between the latch and the striker with the first and second members in the closed position, and attenuating vibrations between the latch and the striker.

19 Claims, 9 Drawing Sheets

(56) References Cited

U.S. PATENT DOCUMENTS 5,482,348 A * 1/1996 Mass ..... E05F 5/022 403/345
5,941,578 A * 8/1999 Shamblin ..... E05B 85/22 292/144
6,119,306 A * 9/2000 Antonucci ..... E05F 5/022 24/297
6,507,976 B2 * 1/2003 Ichimaru ..... E05F 5/022 248/188.4
6,691,380 B2 * 2/2004 Vassiliou ..... F16B 5/0614 24/295
6,923,496 B1 * 8/2005 Pleet ..... B60R 19/48 296/193.11
7,356,879 B2 * 4/2008 Dembowsky ..... F16B 35/041 248/188.4
7,618,088 B2 * 11/2009 Bauer ..... E05F 5/022 296/207
7,690,722 B2 * 4/2010 Boggess ..... B60R 21/34 296/187.04
7,896,601 B2 * 3/2011 Kalyanadurga ..... F16B 21/084 411/510
8,056,965 B2 * 11/2011 Rosemann ..... E05F 5/022 16/86 A
8,382,415 B1 * 2/2013 Goldbaum ..... F16B 39/122 411/383
8,616,622 B2 * 12/2013 Davis ..... E05F 5/022 296/193.11
8,720,975 B1 * 5/2014 Perez ..... B60Q 1/0491 296/187.04
9,212,512 B2 * 12/2015 Nakasone ..... F16F 1/128
9,580,951 B2 * 2/2017 Duprez ..... B60J 5/107
9,610,661 B2 * 4/2017 Burton ..... B23P 19/04
9,726,206 B2 * 8/2017 Spolyar ..... F16B 5/0275
9,963,917 B2 * 5/2018 Reyes Luna ..... E05B 77/42
10,150,355 B2 * 12/2018 Yon ..... B60J 10/50
10,287,813 B2 * 5/2019 Kolar ..... B62D 25/105
10,519,993 B2 * 12/2019 Avalos Sartorio ..... F16B 5/02
10,619,394 B2 * 4/2020 Bell ..... E05F 5/022
10,689,895 B2 * 6/2020 Lamoureux ..... E05F 5/022
11,066,863 B2 * 7/2021 de Marco ..... E05F 5/022
11,180,091 B2 * 11/2021 Brown ..... F16B 11/006
2004/0104592 A1 * 6/2004 Fisher ..... E05B 79/20 296/146.1
2005/0156447 A1 * 7/2005 Bishop ..... E05B 83/16 296/193.11
2006/0097523 A1 * 5/2006 Cetnar ..... E05B 85/26 292/216
2007/0241570 A1 * 10/2007 Paskonis ..... E05B 77/38 292/340
2010/0283271 A1 * 11/2010 Hemingway ..... E05B 85/045 292/341.15
2017/0363123 A1 * 12/2017 Byun ..... F16F 15/04
2020/0392765 A1 * 12/2020 Townson ..... E05B 83/16

* cited by examiner

APPARATUS, METHOD, AND ASSEMBLY FOR ATTENUATING VIBRATIONS BETWEEN A LATCH AND A STRIKER

TECHNOLOGICAL FIELD

The present disclosure relates generally to vibration attenuation. More particularly, the present disclosure relates to an apparatus, a method, and an assembly for attenuating vibrations between a latch and a striker in an assembly.

BACKGROUND

An overhead bin assembly on an aircraft is typically equipped with a latch and a striker mounted to the bin assembly. The latch is often mounted to a door of the bin assembly and the striker is often mounted to an overhead bin portion of the bin assembly, so that when the door is brought into a closed position relative to the overhead bin portion, the latch engages the striker and retains the bin door in a closed position.

However, if any of the components of the bin assembly is not made to within the desired tolerance(s) then vibrations between the components of the bin assembly will likely occur. For example, if the latch and/or the striker are not made to within the desired tolerances then the latch will not securely engage the striker, so that the latch and the striker move against one another and create vibrations during operation of the aircraft. These vibrations are often noisy and a nuisance to aircraft passengers. Further, oftentimes vibrations are created even when components are made to within the desired tolerance(s) due to tolerance stack-up, deformation from gravity, external forces, and/or wear. For example, if the latch and/or striker deform due to gravity, the latch and the striker will move against one another and create vibrations.

In order to address this issue, a current solution includes adding a rubber component to the latch to facilitate a secure engagement of the latch with the striker if the latch and/or striker. Yet, such a rubber component tends to degrade over time and becomes ineffective in enabling the latch to securely engage the striker.

Therefore, a need exists for an apparatus, a method, and an assembly for attenuating vibrations between a latch and a striker, which enables the bin assembly to perform satisfactorily under various conditions including high vibration conditions.

BRIEF SUMMARY

In some example aspects, a vibration-reducing apparatus for an assembly comprising a first member including a latch and a second member including a striker, the latch and the striker being engageable with one another when the first and second members are in a closed position relative to each other, is disclosed. For example, the vibration-reducing apparatus comprises: a threaded post having arm members extending outwardly therefrom, the threaded post being rotatably advanceable in discrete increments in a threaded opening defined by and extending through the first member such that, in the closed position of the first and second members, a distal portion of the threaded post extending through the first member contacts the second member upon rotational advancement of the threaded post in the threaded opening; and a locking region surrounding the threaded opening and being arranged to interact with at least a portion of the arm members of the threaded post upon the rotational advancement of the threaded post in the threaded opening by one of the discrete increments so as to at least prevent rotational retraction of the threaded post, the rotational advancement of the threaded post in the threaded opening and subsequent contact with the second member reducing an engagement distance between the latch and the striker with the first and second members in the closed position, and attenuating vibrations between the latch and the striker.

In another example aspect, a method for vibration-reducing vibrations of an assembly comprising a first member including a latch and a second member including a striker is disclosed. For example, the method comprises arranging the first and second members in a closed position relative to each other such that the latch and the striker are engaged with one another; rotatably advancing a threaded post having arm members extending outwardly therefrom in discrete increments in a threaded opening extending through the first member until a distal portion of the threaded post extending through the first member contacts the second member; and interacting a locking region in the first member surrounding the threaded opening with at least a portion of the arm members of the threaded post upon rotatably advancing the threaded post in the threaded opening by one of the discrete increments so as to at least prevent rotational retraction of the threaded post, the rotational advancement of the threaded post in the threaded opening and subsequent contact with the second member reducing an engagement distance between the latch and the striker with the first and second members in the closed position, and attenuating vibrations between the latch and the striker.

In another example aspect, an assembly is disclosed. For example, the assembly comprises a first member including a latch and a second member including a striker, the latch and the striker being engageable with one another when the first and second members are in a closed position relative to each other, the assembly comprising a vibration-reducing apparatus arranged with respect to the assembly to reduce an engagement distance and to attenuate vibrations between the latch and the striker with the first and second members in the closed position.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended to be combinable, unless the context of the disclosure clearly dictates otherwise.

BRIEF DESCRIPTION OF THE DRAWING(S)

Having thus described examples of the disclosure in general terms, reference will now be made to the accompanying drawings, which are not necessarily drawn to scale, and wherein:

DETAILED DESCRIPTION

Figure 1A:
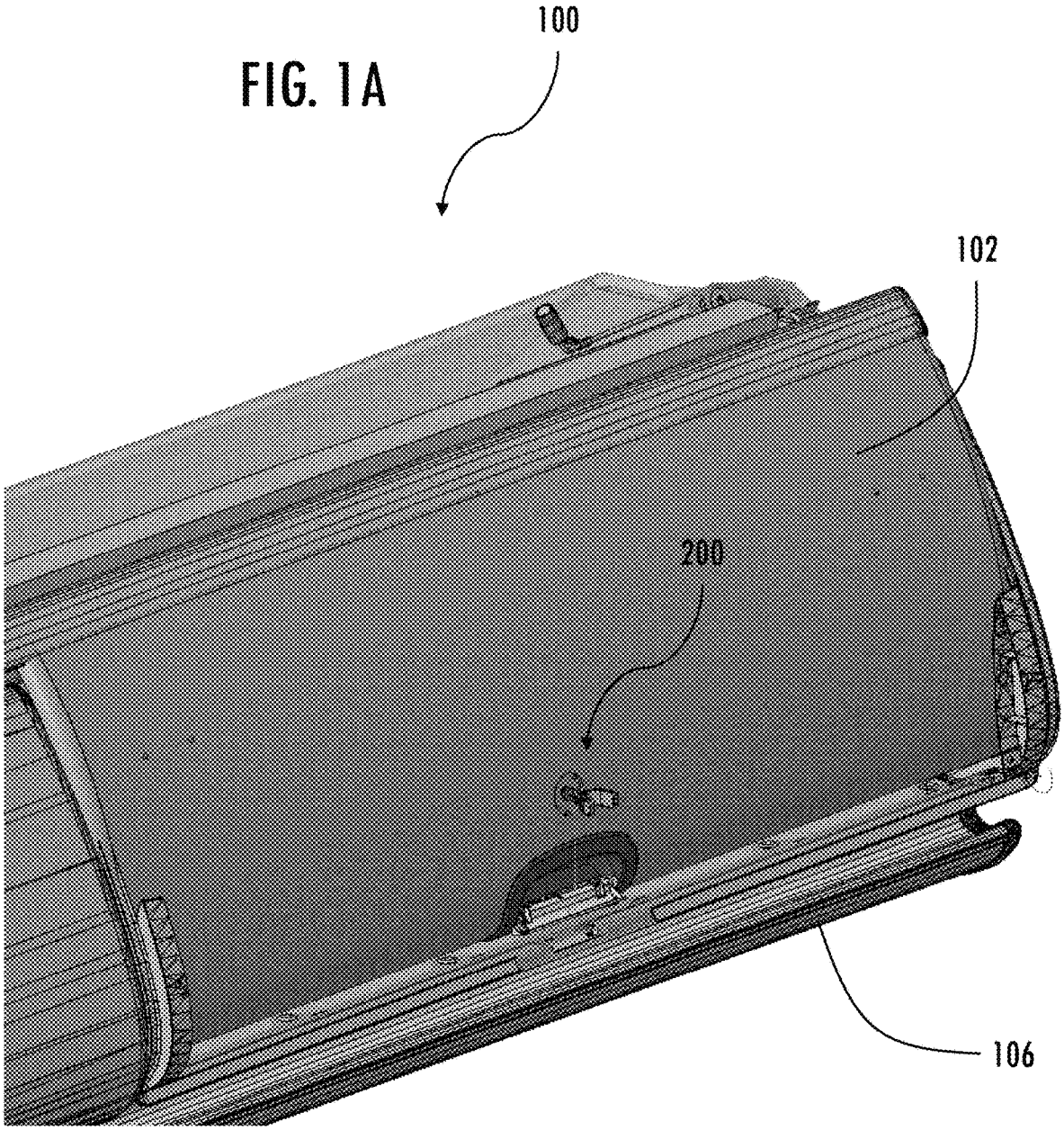
FIG. 1A illustrates an assembly including first and second members in a closed position relative to each other and a vibration-reducing apparatus arranged on the first member of the assembly according to various aspects of the present disclosure.

Some examples of the present disclosure will now be described more fully hereinafter with reference to the accompanying drawings, in which some, but not all examples of the disclosure are shown. Indeed, various examples of the disclosure may be embodied in many different forms and should not be construed as limited to the examples set forth herein; rather, these examples are provided so that this disclosure will be thorough and complete, and will fully convey the scope of the disclosure to those skilled in the art. For example, unless otherwise indicated, reference to something as being a first, second or the like should not be construed to imply a particular order. Also, something described as being above something else (unless otherwise indicated) may instead be below, and vice versa; and similarly, something described as being to the left of something else may instead be to the right, and vice versa. Like reference numerals refer to like elements throughout.

Examples of the present disclosure are generally directed to an apparatus, a method, and an assembly for attenuating vibrations between a latch and striker. In some aspects, the latch is included on a first member and the striker is included on a second member, where the latch and the striker are engageable with one another when the first and second members are in a closed position relative to each other. Alternatively, the latch is included on the second member and the striker is included on the first member. In one example, the first member comprises a moveable or pivotable door and the second member comprises a stationary compartment. Accordingly, in this example, the first and second members form an assembly that is selected from an overhead bin in an aircraft, an automobile trunk, body panels of machinery (e.g., generators, engine shrouds/heat shields), or other applications where there is play between members or bodies in a potential vibration environment. Examples include a lid and a container, a door and a cabinet or booth or locker or the like; a cover and an apparatus; a hood and an automobile or tractor or the like; a cap and a container; a lid and a container; and the like.

As used herein, "attenuating vibrations" is defined as the reduction or dissipation of energy or motion between the first and second members of the assembly. Vibration between the first and second members between the assembly occur if, for example, any components of the assembly are not made to within desired tolerances or if any of the components have been subjected to tolerance stack-up, deformation from gravity, external forces, and/or wear. For example, if the latch is made too large or if the latch deforms due to gravity, then the latch will either not securely engage the striker or will slip out of engagement with the striker when the first and second members are in the closed position. In either instance, any distance between the latch and the striker that is greater than an allowable design gap (i.e., a distance between the latch and the striker that enables secure engagement of the latch with the striker) will result in movement between the latch and the striker, with vibrations resulting therefrom. These vibrations, which can manifest as rattling, are often noisy enough to be a nuisance.

Accordingly, the apparatus, the method, and the assembly disclosed herein attenuate vibrations by reducing an engagement distance between the latch and the striker with the first and second members in the closed position, so that vibrations between the latch and the striker are attenuated or reduced. More particularly, the apparatus, the method, and the assembly disclosed herein are directed to attenuating vibrations between the latch and the striker by reducing the engagement distance between the latch and the striker to an allowable design gap, the allowable design gap being determined by design intent, hardness or rigidity of the striker/latch, tolerance(s), etc.

For example, and as illustrated in FIG. 1A, an assembly 100 comprising a first member 102 including a latch 104 (FIG. 1B) and a second member 106 including a striker 108 (FIG. 1B) is illustrated. The assembly 100 is an overhead bin assembly useful in, for example, an aircraft, where the first member 102 is a bin door and the second member 106 is an overhead bin. However, the assembly 100 can be any type of assembly where the first member 102 is a moveable door, cover, hood, cap, lid, and the like, and the second member 106 is a stationary compartment, container, apparatus, locker, booth, holder, and the like.

Figure 1B:
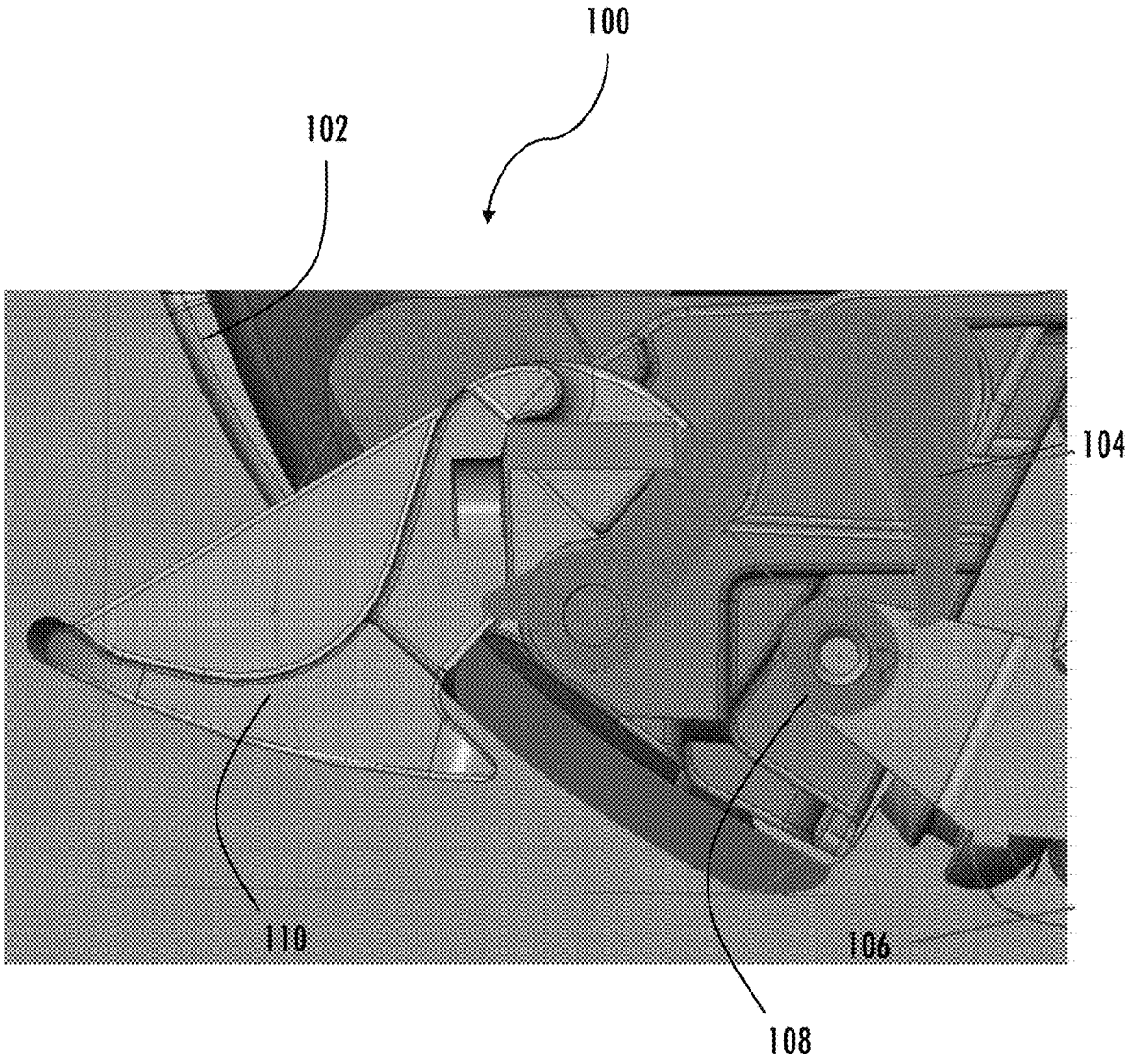
FIG. 1B illustrates a cross-sectional view of the assembly of FIG. 1A.

FIG. 1B illustrates a cross-sectional view of the latch 104 and the striker 108 of the assembly 100 of FIG. 1A. The latch 104 and the striker 108 form any type of mechanical fastener arrangement that joins two members together (i.e., the first and second members 102, 106) while allowing for regular separation. As shown in FIG. 1B, the latch 104 and the striker 108 are arranged so that they are engageable with one another when the first and second members 102, 106 are in a closed position relative to each other. More particularly, a handle 110 that a user interacts with to move the first member 102 relative to the second member 106 is provided on the first member 102. As shown in FIG. 1B, the handle 110 is in an open position. The handle 110 extends from an exterior surface of the first member 102 to an opposite, interior surface thereof. The latch 104 is pivotably attached to a portion of the handle 110 arranged about the interior surface of the first member 102. A biasing member (not shown) applies a force at the pivotable attachment of the handle 110 and the latch 104 to bias the handle 110 into the closed position. This biasing member force opposes a force applied to the handle 110 by a user to move the handle 110 out of the closed position and into the open position.

When the handle 110 is in an open position, as shown in FIG. 1B, the latch 104 is not engaged with the striker 108 so that the first member 102 is moveable or pivotable into an open position relative to the second member 106. When the handle 110 is in the closed position, the latch 104 is engaged with the striker 108 so that the first member 102 is in a closed position relative to the second member 106. The present invention seeks reduce any engagement distance between the latch 104 and the striker 108 that is greater than an allowable design gap as any such engagement distance results in movement between the latch 104 and the striker 108 and vibrations resulting therefrom.

Referring back to FIG. 1A, the assembly 100 further comprises a vibration-reducing apparatus, generally designated 200, arranged with respect to the assembly 100 to reduce an engagement distance between the latch 104 and the striker 108 and thereby attenuate vibrations between the latch 104 and the striker 108 with the first and second members 102, 106 in the closed position. The vibration-reducing apparatus illustrated in FIG. 1A is a first embodiment of a vibration-reducing apparatus, which is described in more detail in FIGS. 2A and 2B. However, any vibration-reducing apparatus as described herein or contemplated by this application is usable with regard to the assembly 100.

Figure 2A:
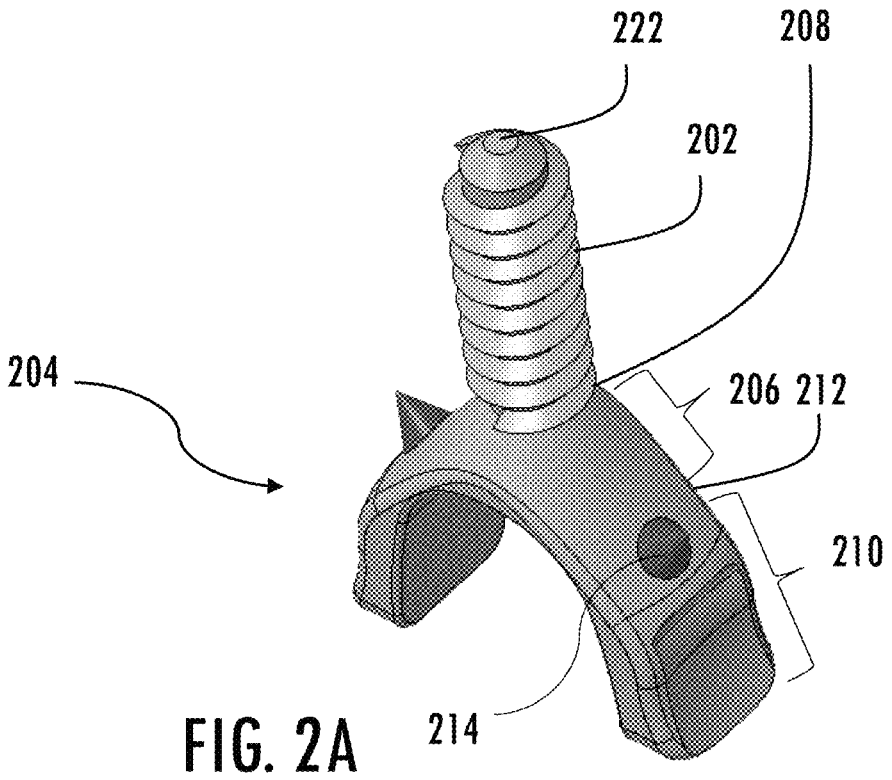
FIGS. 2A and 2B illustrate a first embodiment of a vibration-reducing apparatus including a threaded post and a locking region according to various aspects of the present disclosure.
Figure 2B:
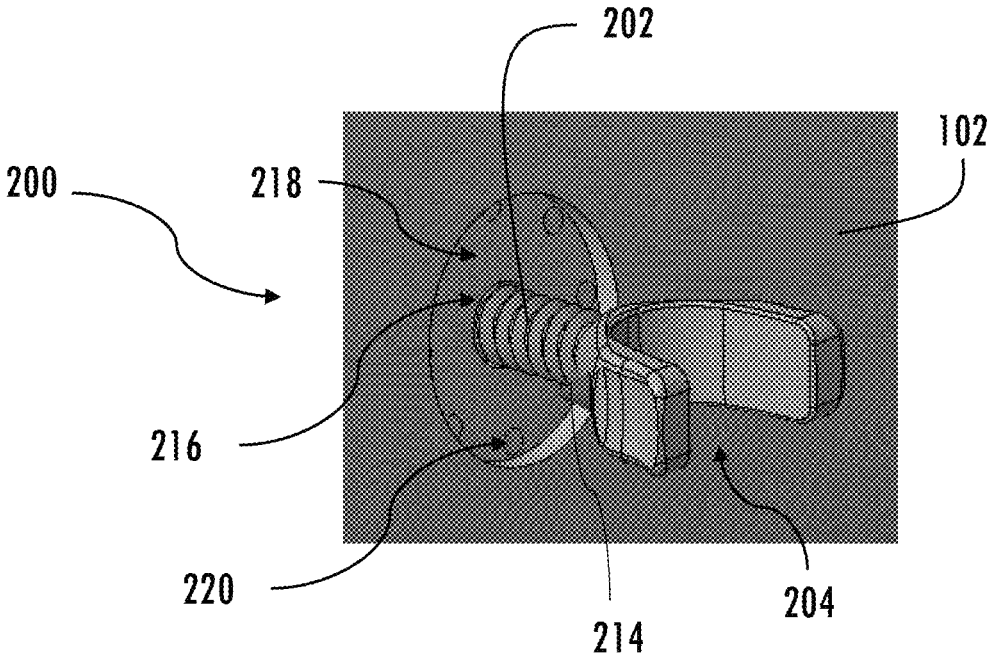

As illustrated in FIGS. 2A and 2B, the vibration-reducing apparatus 200 comprises, in some example aspects, a threaded post 202 having arm members 204 extending outwardly therefrom. As illustrated in FIGS. 2A and 2B, the threaded post 202 has two arm members 204, although more arm members or less arm members are contemplated by this embodiment, such as from about 1 to about 10 arm members or about 2, 3, 4, 5, 6, 7, 8 or 9 arm members.

In some example aspects, the arm members 204 of the threaded post 202 each include a first portion 206 extending radially outward from an end portion 208 of the post 202 and a second portion 210 extending from a distal end 212 of the first portion 206. The second portions 210 are resiliently deformable toward each other. The second portion 210 of the arm members 204 each includes a protrusion 214 extending outwardly therefrom. As illustrated in FIGS. 2A and 2B, the protrusion 214 extends outwardly from the second portions 210 so that the protrusion 214 is at an acute angle or about 45 degrees relative to a longitudinal axis of the threaded post 202. The protrusion can be of any shape, such as spherical, triangular, cubical, rectangular, or a polygon having from about 4 to about 10 sides, or about 6 to about 8 sides. The protrusion can be of a rubber material, such as a fluoropolymer, fluoroelastomer, silicon rubber or any rubber or elastomeric material having suitable flexibility and conformabilty.

The threaded post 202 is rotatably advanceable in discrete increments in a threaded opening 216 defined by and extending through the first member 102. The threaded opening 216 longitudinally extends from the exterior surface to the opposite, interior surface of the first member 102 and includes threads therethrough. The threaded post 202 is thereby rotatable within the threaded opening 216 such that rotation of the threaded post 202 results in the arm members 204 advancing towards the exterior surface of the first member 102. In addition, the distal end of the threaded post 202 moves toward the second portion 210 upon rotation of the threaded post 202 so as to urge the first portion 206 away from the second portion 210. In doing so, the engagement distance between the latch 104 and striker 108 is reduced to the extent necessary to prevent undesirable vibration therebetween.

In some example aspects, the threaded post 202 comprises a metal, a plastic, or an elastomeric material. The elastomeric material is selected from the group consisting of silicones, siloxanes, nitriles, fluoropolymers, fluoroelastomers, neoprenes, and combinations thereof. The elastomeric material of the threaded post 202 has a hardness of from about 10 to about 100 Shore 00, from about 0 to about 100 shore A, or from about 0 to about 80 shore D. The threaded post 202 is manufactured by injection molding, compressive molding, extruding, or the like.

A locking region 218 surrounds the threaded opening 216 on the first member 102. In some example aspects, the locking region 218 comprises a metal, a plastic, or an elastomeric material. The elastomeric material is selected from the group consisting of silicones, siloxanes, nitriles, fluoropolymers, fluoroelastomers, neoprenes, and combinations thereof; the plastic is selected from polyethylene, polypropylene or the like; and the metal is selected from steel, aluminum, titanium, and the like, and alloys thereof. The elastomeric material of the locking region 218 has a hardness of from about 10 to 100 Shore 00, about 0 to 100 shore A, or about 0 to 80 shore D. The locking region 218 is manufactured by injection molding, compressive molding, extruding, stamping of the first member 102, or the like. As illustrated in FIG. 2B, for example, the locking region 218 is stamped using a die or otherwise formed directly on an exterior surface of the first member 102 and surrounding the threaded opening 216. Alternatively, the locking region 218 is a component joined to the exterior surface of the first member 102.

As illustrated in FIG. 2B, the locking region 218 defines spaced-apart depressions 220 extending about the opening 216. The locking region 218 and/or the depressions 220 are arranged to interact with at least a portion of the arm members 204 of the threaded post 202 upon the rotational advancement of the threaded post 202 in the threaded opening 216 by one of the discrete increments so as to at least prevent or substantially hinder rotational retraction of the threaded post 202. As used herein, "discrete increments" refers to a continuous distance that the threaded post 202 is rotatable in a single direction. This distance directly corresponds to an arrangement of the depressions 220 of the locking region 218, where a distance between two individual depressions 220 defines the distance that the threaded post 202 is rotatable continuously. More particularly, the threaded post 202 is arranged to continuously rotate in the threaded opening 216 until at least a portion of each of the arm members 204 interacts with a corresponding one of the depressions 220. The distance that the threaded post 202 rotates until at least a portion of each of the arm members 204 interacts with the corresponding one of the depressions 220 is a discrete increment. The threaded post 202 is then rotatable another discrete increment or until at least a portion of each of the arm members 204 interacts with a corresponding, successive one of the depressions 220. In this manner, the protrusions 214 are receivable by corresponding depressions 220 upon the rotational advancement of the threaded post 202 by at least one of the discrete increments in the threaded opening 216.

In some example aspects, in the closed position of the first and second members 102, 106, a distal portion 222 of the threaded post 202 extending through the first member 102 contacts the second member 106 upon rotational advancement of the threaded post 202 in the threaded opening 216. More particularly, rotational advancement of the threaded post 202 in the threaded opening 216 and subsequent contact with the second member 106 causes tension between the first member 102 and the second member 106 (i.e., the threaded post 202 pushes the first member 102 away from the second member 106). This tension between the first member 102 and the second member 106 reduces the engagement distance between the latch 104 and the striker 108 with the first and second members 102, 106 in the closed position, and thereby attenuates vibrations between the latch 104 and the striker 108.

Figure 3A:
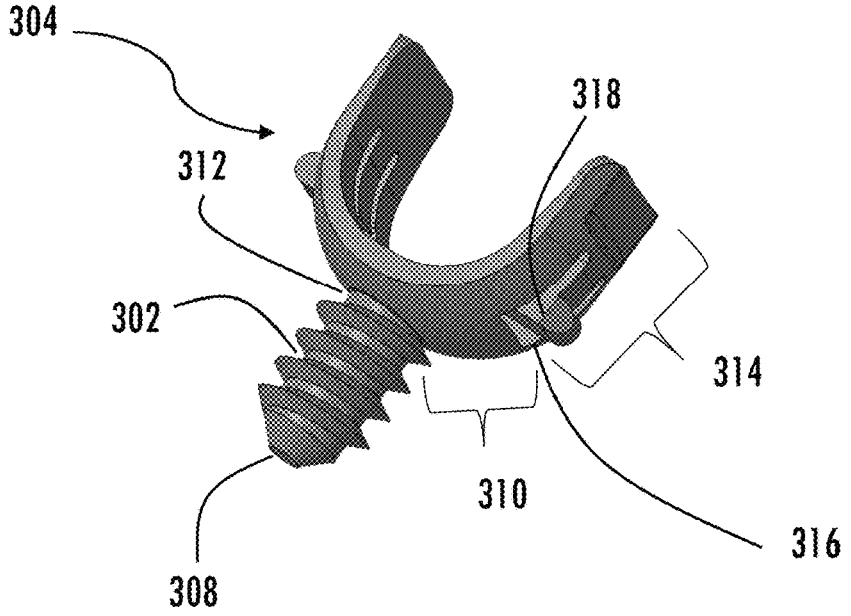
FIGS. 3A and 3B illustrate a second embodiment of a vibration-reducing apparatus according to various aspects of the present disclosure.
Figure 3B:
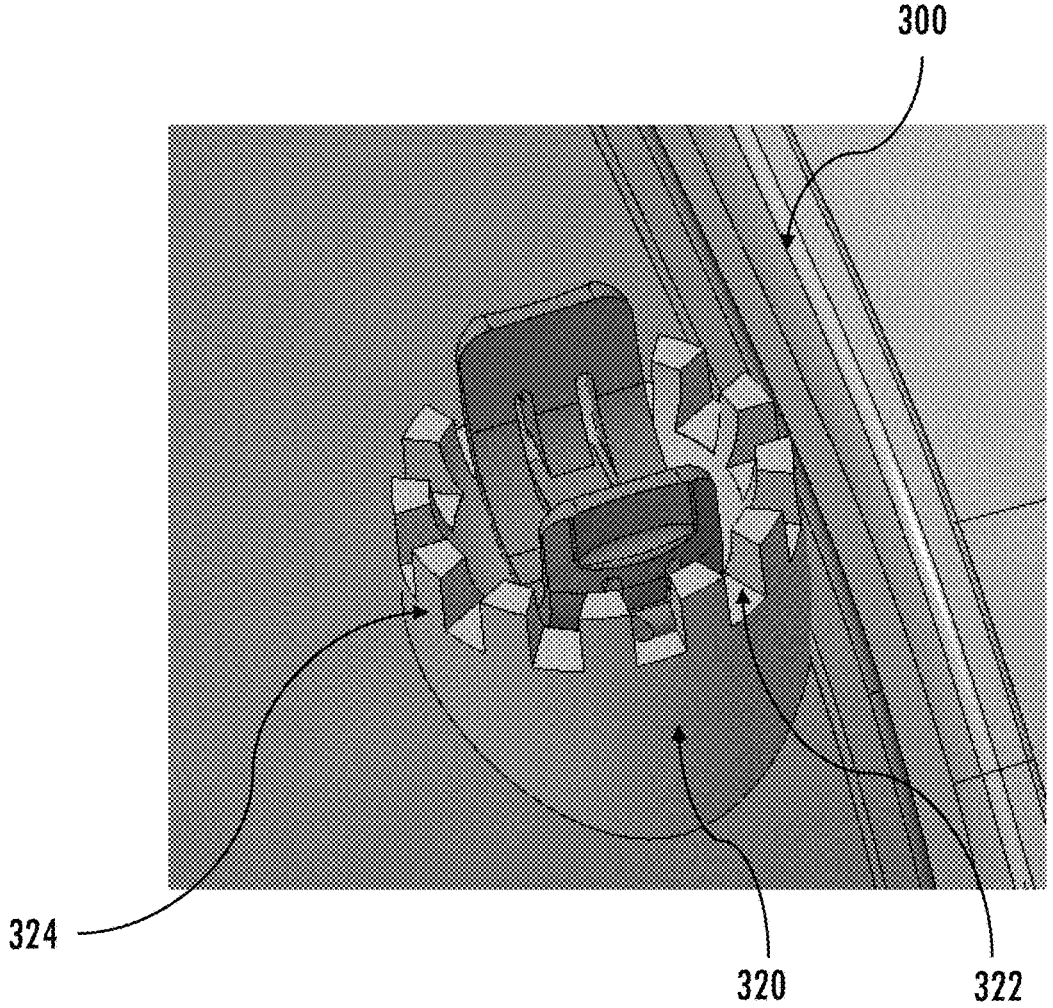
Figure 3C:
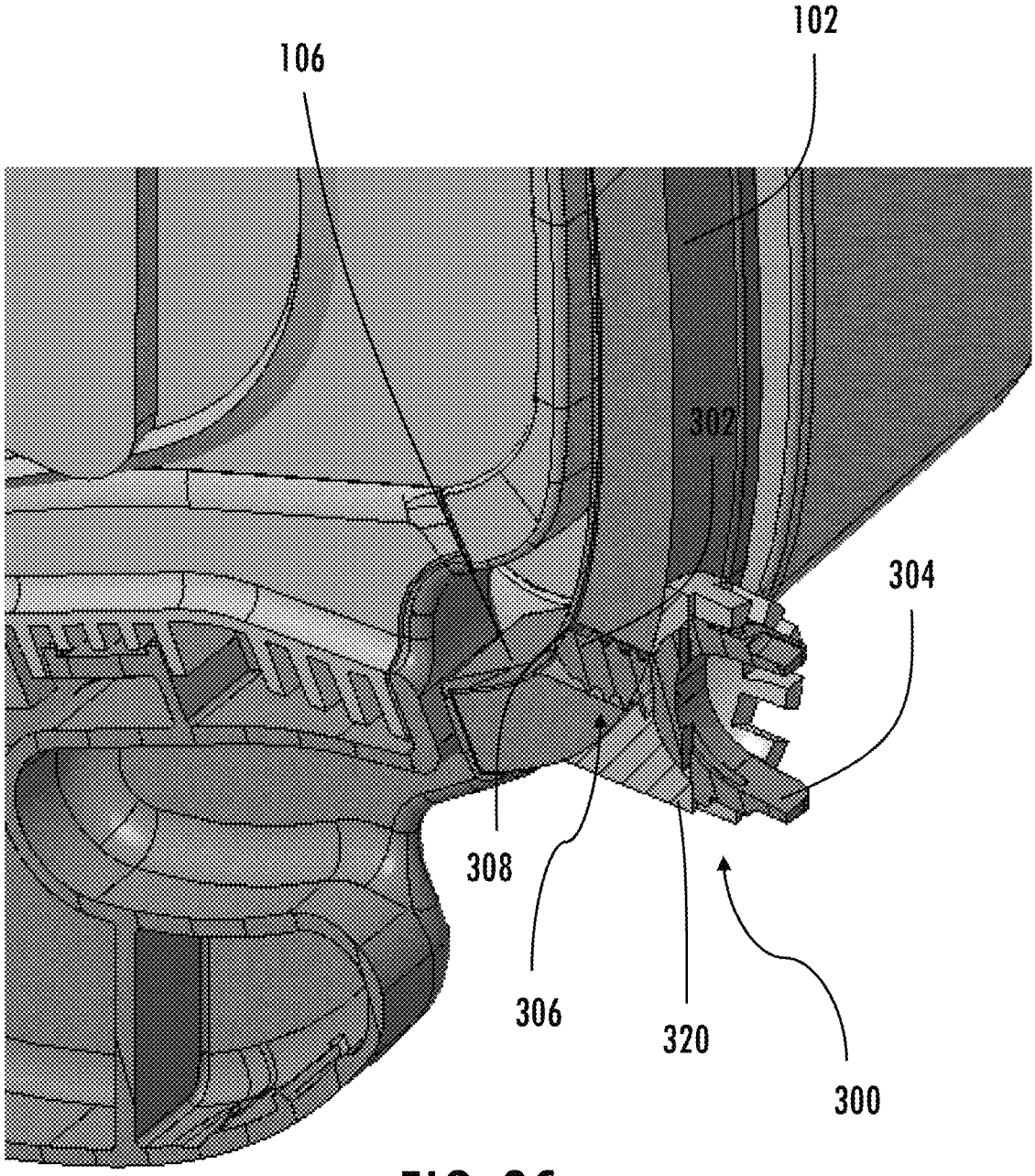
FIG. 3C illustrates a cross-sectional view of the vibration-reducing apparatus of FIGS. 3A and 3B.

Another embodiment of a vibration-reducing apparatus is illustrated in FIGS. 3A and 3B and an embodiment of the vibration-reducing apparatus of FIGS. 3A and 3B provided in an assembly is illustrated in FIG. 3C. More particularly, the vibration-reducing apparatus 300 comprises a threaded post 302 having arm members 304 extending outwardly therefrom. As illustrated in FIGS. 3A and 3B, the threaded post 302 has two arm members 304, although more arm members or less arm members are contemplated by this embodiment. The threaded post 302 is rotatably advanceable in discrete increments in a threaded opening 306 (FIG. 3C) defined by and extending through a first member (e.g., first member 102 in FIG. 1A) such that, in the closed position of the first member and a second member (e.g., second member 106 in FIG. 1A), a distal portion 308 of the threaded post 302 extending through the first member contacts the second member upon rotational advancement of the threaded post 302 in the threaded opening 306.

In some example aspects, the arm members 304 of the threaded post 302 each include a first portion 310 extending radially outward from an end portion 312 of the post 302 and a second portion 314 extending from a distal end 316 of the first portion 310. The second portions 314 of the arm members 304 are resiliently deformable toward each other (i.e., are able to be temporarily moved towards each other upon application of stress thereto). The second portions 314 of the arm members 304 each include a protrusion 318 extending outwardly therefrom. As illustrated in FIGS. 3A and 3B, the protrusion 318 extends outwardly from the second portions 314 so that the protrusion 318 is substantially perpendicular to a longitudinal axis of the threaded post 302.

The vibration-reducing apparatus 300 further comprises a locking region 320. The locking region 320 is a component extending outwardly from the exterior surface of the first member and surrounding the threaded opening 306. The locking region 320, as illustrated in FIG. 3B, defines spaced-apart depressions 322 extending about the opening 306 and a plurality of angularly spaced-apart tines 324. Two successive spaced-apart tines 324 define one of the depressions 322 therebetween, such that a discrete increment is defined by the depressions 322 or the distance between two successive spaced-apart tines 324. In this manner, the protrusions 318 are receivable by corresponding depressions 322 upon the rotational advancement of the threaded post 302 by at least one of the discrete increments in the threaded opening 306.

FIG. 3C illustrates a cross-sectional view of the apparatus 300 provided on an assembly including the first member 102 and the second member 106 of FIGS. 1A and 1B. As illustrated in FIG. 3C, the locking region 320 is arranged to interact with at least a portion of the arm members 304 of the threaded post 302 upon the rotational advancement of the threaded post 302 in the threaded opening 306 by one of the discrete increments so as to at least prevent rotational retraction of the threaded post 302 (e.g., outwardly of the threaded opening 306/first member 102). The rotational advancement of the threaded post 302 in the threaded opening 306 and subsequent contact with the second member 106 reduces an engagement distance between a latch (e.g., latch 104 in FIG. 1B) included on the first member 102 and a striker (e.g., striker 108 in FIG. 1B) included on the second member 106 with the first and second members 102, 106 in the closed position, and attenuates vibrations between the latch and the striker.

Figure 4A:
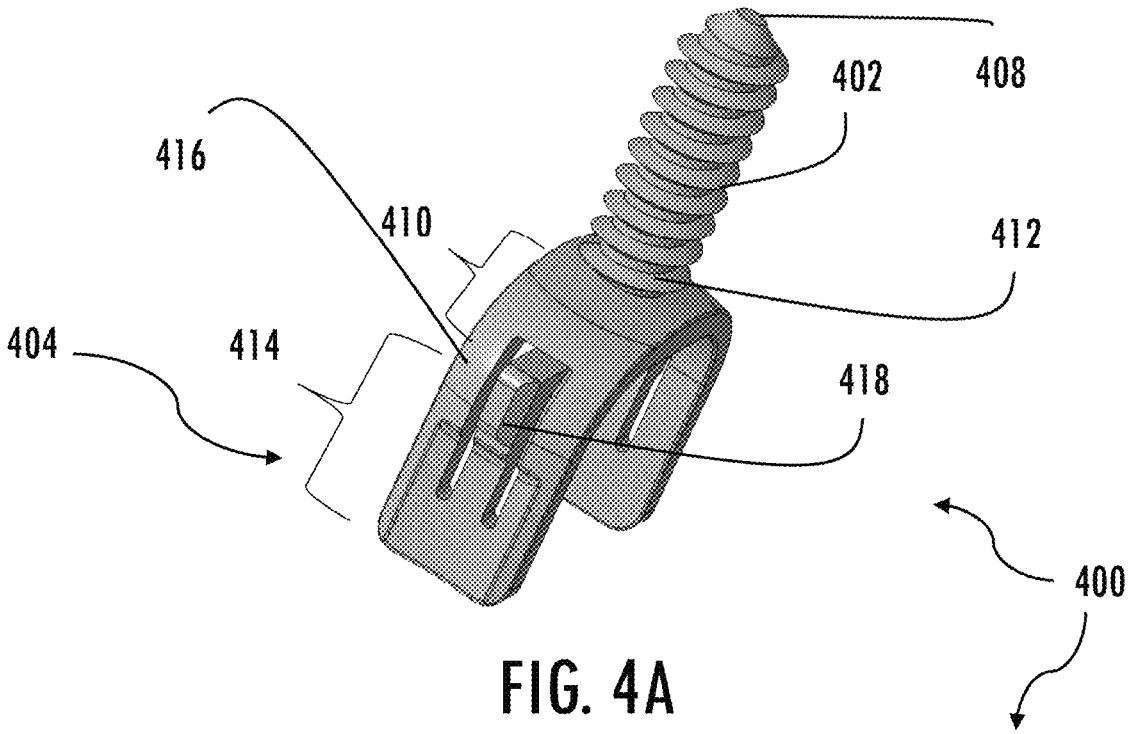
FIGS. 4A and 4B illustrate a third embodiment of a vibration-reducing apparatus including a threaded post and a locking region according to various aspects of the present disclosure.
Figure 4B:
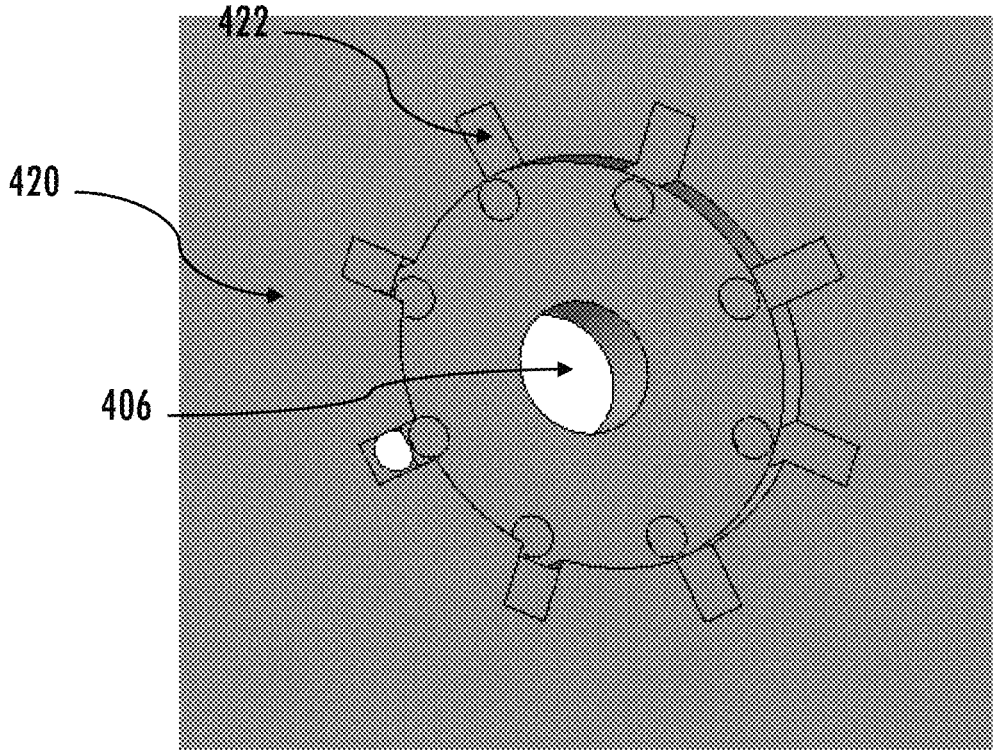

Still another embodiment of a vibration-reducing apparatus is illustrated in FIGS. 4A and 4B. More particularly, the vibration-reducing apparatus 400 comprises a threaded post 402 having arm members 404 extending outwardly therefrom. As illustrated in FIGS. 4A and 4B, the threaded post 402 has two arm members 404, although more arm members or less arm members are contemplated by this embodiment. The threaded post 402 is rotatably advanceable in discrete increments in a threaded opening 406 defined by and extending through a first member (e.g., first member 102 in FIG. 1A) such that, in the closed position of the first member and a second member (e.g., second member 106 in FIG. 1A), a distal portion 408 of the threaded post 402 extending through the first member contacts the second member upon rotational advancement of the threaded post 402 in the threaded opening 406.

In some example aspects, the arm members 404 of the threaded post 402 each include a first portion 410 extending radially outward from an end portion 412 of the post 402 and a second portion 414 extending from a distal end 416 of the first portion 410. The second portions 414 of the arm members 404 are resiliently deformable toward each other. The second portions 414 of the arm members 404 each include a protrusion 418 extending outwardly therefrom. As illustrated in FIGS. 4A and 4B, the protrusion 418 extends outwardly from the second portions 414 so that the protrusion 418 is substantially perpendicular to a longitudinal axis of the threaded post 402.

The vibration-reducing apparatus 400 further comprises a locking region 420. The locking region 420 is stamped using a die or otherwise formed directly on an exterior surface of the first member and surrounding the threaded opening 406. Alternatively, the locking region 420 is a component joined to the exterior surface of the first member. The locking region 420, as illustrated in FIG. 4B, defines spaced-apart depressions or grooves 422 extending about the opening 406. A discrete increment is defined by the depressions or grooves 422 or the distance between two successive grooves 422. In this manner, the protrusions 418 are receivable by corresponding grooves 422 upon the rotational advancement of the threaded post 402 by at least one of the discrete increments in the threaded opening 406.

Figure 5A:
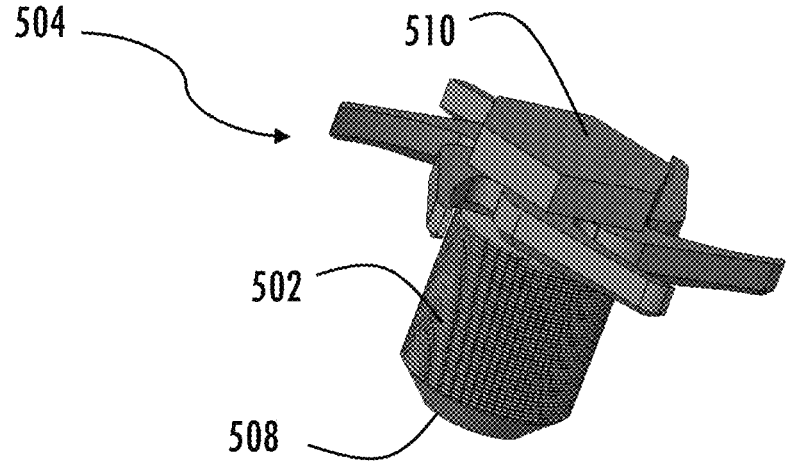
FIGS. 5A and 5B illustrate a fourth embodiment of a vibration-reducing apparatus including a threaded post and a locking region according to various aspects of the present disclosure.
Figure 5B:
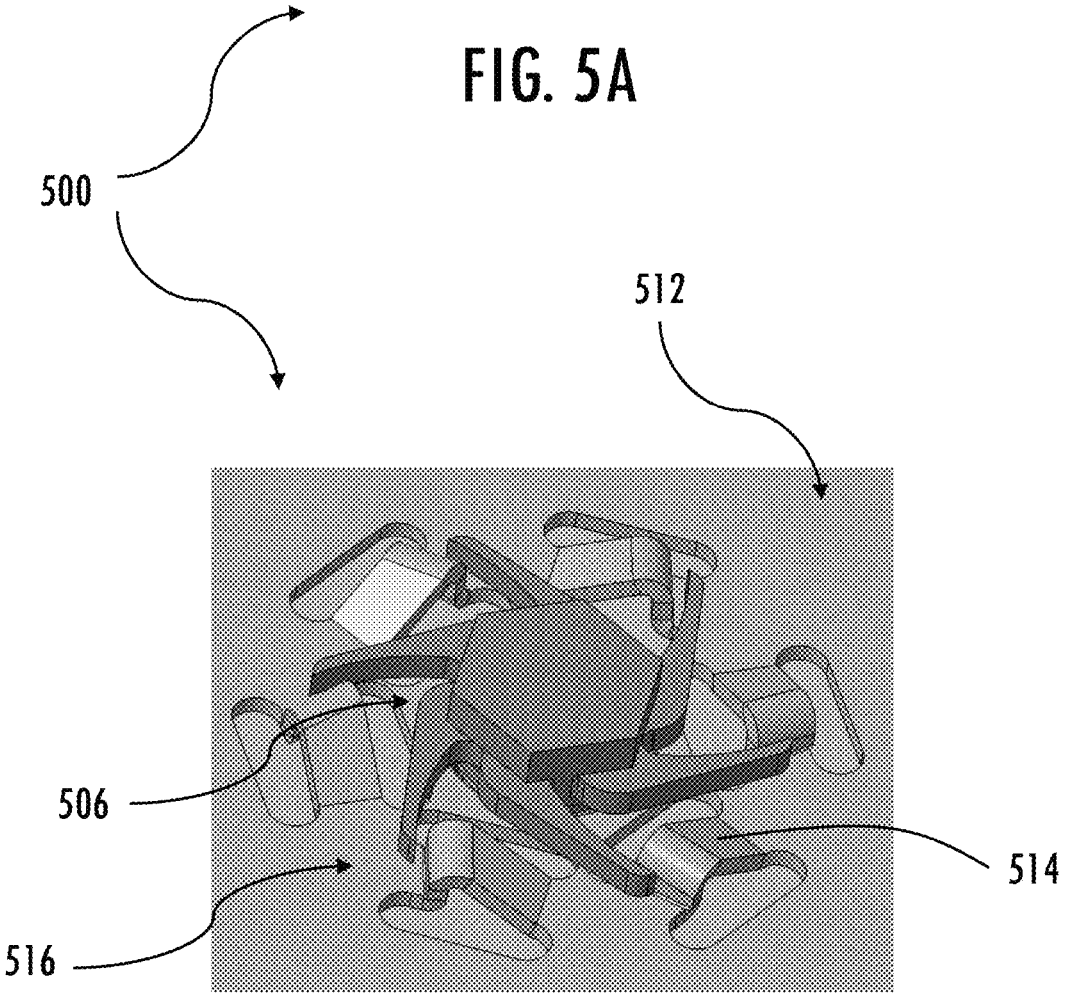

A still further embodiment of a vibration-reducing apparatus is illustrated in FIGS. 5A and 5B. More particularly, the vibration-reducing apparatus 500 comprises a threaded post 502 having arm members 504 extending outwardly therefrom. As illustrated in FIGS. 5A and 5B, the threaded post 502 has six arm members 504, although more arm members or less arm members, such as from about 1 to about 10, or about 2, 3, 4, 5, 6, 7, 8, or 9 are contemplated by this embodiment. The threaded post 502 is rotatably advanceable in discrete increments in a threaded opening 506 defined by and extending through a first member (e.g., first member 102 in FIG. 1A) such that, in the closed position of the first member and a second member (e.g., second member 106 in FIG. 1A), a distal portion 508 of the threaded post 502 extending through the first member contacts the second member upon rotational advancement of the threaded post 502 in the threaded opening 506.

In some example aspects, the arm members 504 of the threaded post 502 are angularly spaced-apart and extend radially outward from an end portion 510 of the threaded post 502. As illustrated in FIGS. 5A and 5B, each of the arm members 504 is angled about 60 degrees relative to longitudinal axis of the threaded post 502.

The vibration-reducing apparatus 500 further comprises a locking region 512. The locking region 512 is stamped using a die or otherwise formed directly on an exterior surface of the first member and surrounding the threaded opening 506. Alternatively, the locking region 512 is an component joined to the exterior surface of the first member. The locking region 512, as illustrated in FIG. 5B, comprises a plurality of angularly spaced-apart raised elements 514 extending longitudinally outward of the opening 506, where areas 516 of the locking region 512 between the successive spaced-apart raised elements 514 are correspondingly angularly spaced-apart, e.g., are spaced apart about 60 degrees. As such, a discrete increment is defined by the raised elements 514 or the distance between two successive raised elements 514. In this manner, each of the arm members 504 are receivable by corresponding angularly spaced-apart areas 516 of the locking region 520 upon rotational advancement of the threaded post 502 by at least one of the discrete increments in the threaded opening 506. The parts of the locking region 512 can be comprised of any suitable plastic or metal material such as polypropylene, polyethylene, aluminum, steel, titanium, and the like.

Figure 6:
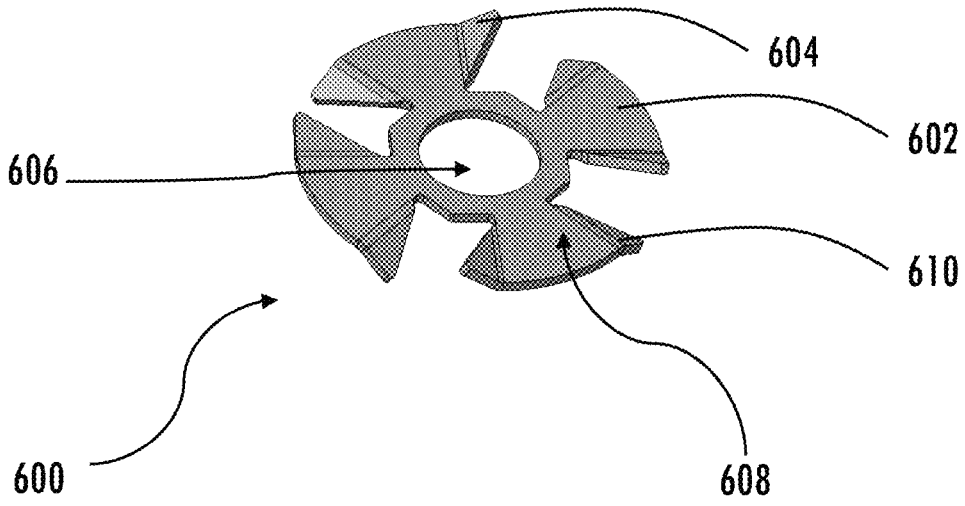
FIG. 6 illustrates a fifth embodiment of a locking region of a vibration-reducing apparatus according to various aspects of the present disclosure.

FIG. 6 illustrates an alternative to the locking region 512 in FIG. 5B. For example, a locking region 600 in FIG. 6 comprises a washer 602. The washer 602 includes a plurality of angularly spaced-apart raised elements 604 similar to the raised elements 514 in FIG. 5B, as well as a central opening 606. A discrete increment is defined by the raised elements 604 or the distance between two successive raised elements 604. In this manner, each of the arm members of a threaded post (e.g., threaded post 502 in FIG. 5A) is receivable by corresponding angularly spaced-apart areas 608 of the locking region 600 upon rotational advancement of the threaded post by at least one of the discrete increments. There can be from about 1 to about 10 washers 602, such as from 2, 3, 4, 5, 6, 7, 8, or 9 washers. The washers can be comprised of any suitable plastic or metal material such as polypropylene, polyethylene, aluminum, steel, titanium, and the like.

However, rather than being stamped using a die or otherwise formed directly on an exterior surface of the first member, the washer 602 is stamped from a piece of material and then embedded in a first member (e.g., first member 102 in FIG. 1A) so that the central opening 606 is aligned with a threaded opening of the first member. More particularly, embedding elements 610 are angularly spaced-apart but oriented in a direction opposite from the angularly spaced-apart raised elements 604. The embedding elements 610 are formed so that they embed into the exterior surface of the first member upon applied force thereto.

Figure 7:
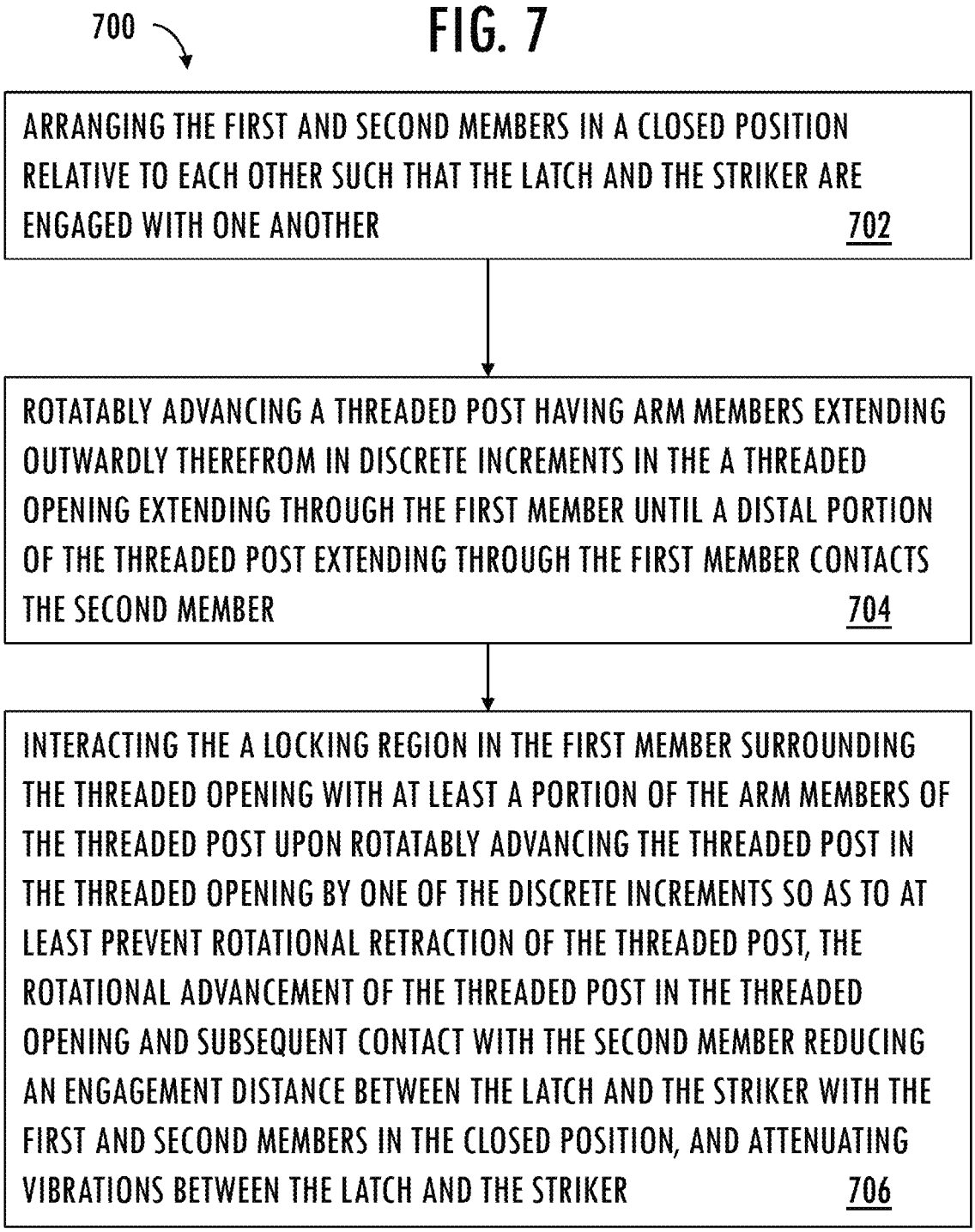
FIG. 7 illustrates a method for vibration-reducing vibrations of an assembly comprising a first member and a second member according to various aspects of the present disclosure.

A method for vibration-reducing vibrations of an assembly comprising a first member including a latch and a second member including a striker is illustrated in FIG. 7. The method, generally referred to as reference numeral 700, is applicable to the vibration-reducing apparatus described in any of the embodiments hereinabove or any other embodiment contemplated by this disclosure. In a first step, 702, the first and second members are arranged in a closed position relative to each other such that the latch and the striker are engaged with one another. In a second step, 704, a threaded post having arm members extending outwardly therefrom is rotatably advanced in discrete increments in a threaded opening extending through the first member until a distal portion of the threaded post extending through the first member contacts the second member. In a third step, 706, a locking region in the first member surrounding the threaded opening is interacted with at least a portion of the arm members of the threaded post upon rotatably advancing the threaded post in the threaded opening by one of the discrete increments so as to at least prevent rotational retraction of the threaded post, the rotational advancement of the threaded post in the threaded opening and subsequent contact with the second member reducing an engagement distance between the latch and the striker with the first and second members in the closed position, and attenuating vibrations between the latch and the striker.

In the method 700, in some example aspects, the arm members of the threaded post each include a first portion extending radially outward from an end portion of the post and a second portion extending from a distal end of the first portion and including a protrusion extending outwardly therefrom. In this manner, rotatably advancing the threaded post comprises resiliently deforming the second portion of each of the arm members toward each other and rotatably advancing the threaded post in discrete increments in the threaded opening until the protrusions of the arm members interact with spaced-apart depressions extending about the opening and defined by the locking region.

In some still further example aspects, the arm members of the threaded post are angularly spaced-apart and extend radially outward from an end portion of the threaded post. In this manner, rotatably advancing the threaded post comprises rotatably advancing the threaded post in discrete increments in the threaded opening until the arm members interact with a plurality of angularly spaced-apart raised elements defined by the locking region and extending longitudinally outward of the opening, and are received by corresponding angularly spaced-apart areas of the locking region between the successive spaced-apart elements.

Many modifications and other examples of the disclosure set forth herein will come to mind to one skilled in the art to which the disclosure pertains having the benefit of the teachings presented in the foregoing description and the associated drawings. Therefore, it is to be understood that the disclosure is not to be limited to the specific examples disclosed and that modifications and other examples are intended to be included within the scope of the appended claims. Moreover, although the foregoing description and the associated drawings describe examples in the context of certain example combinations of elements and/or functions, it should be appreciated that different combinations of elements and/or functions may be provided by alternative examples without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A vibration-reducing apparatus for an assembly comprising a first member including a latch and a second member including a striker, the latch and the striker being engageable with one another when the first and second members are in a closed position relative to each other, the vibration-reducing apparatus comprising:

a threaded post having arm members extending outwardly therefrom, the threaded post being rotatably advanceable in discrete increments in a threaded opening defined by and extending through the first member such that, in the closed position of the first and second members, a distal portion of the threaded post extending through the first member contacts the second member upon rotational advancement of the threaded post in the threaded opening; and a locking region surrounding the threaded opening and being arranged to interact with at least a portion of the arm members of the threaded post upon the rotational advancement of the threaded post in the threaded opening by one of the discrete increments so as to at least prevent rotational retraction of the threaded post, the rotational advancement of the threaded post in the threaded opening and subsequent contact with the second member reducing an engagement distance between the latch and the striker with the first and second members in the closed position, and attenuating vibrations between the latch and the striker.

2. The apparatus of claim 1, wherein the arm members of the threaded post each include a first portion extending radially outward from an end portion of the threaded post and a second portion extending from a distal end of the first portion, the second portion of each of the arm members being resiliently deformable toward each other.

3. The apparatus of claim 2, wherein the second portion of the arm members each include a protrusion extending outwardly therefrom, and wherein the locking region defines spaced-apart depressions extending about the opening, the protrusion of each of the arm members being receivable by the corresponding depressions upon the rotational advancement of the threaded post by at least one of the discrete increments in the threaded opening.

4. The apparatus of claim 3, wherein the locking region includes a plurality of angularly spaced-apart tines, and wherein two successive spaced-apart tines define one of the depressions therebetween.

5. The apparatus of claim 1, wherein the locking region comprises a plurality of angularly spaced-apart raised elements extending longitudinally outward of the opening.

6. The apparatus of claim 5, wherein areas of the locking region between the successive angularly spaced-apart raised elements are correspondingly angularly spaced-apart areas.

7. The apparatus of claim 6, wherein the arm members of the threaded post are angularly spaced-apart and extend radially outward from an end portion of the threaded post, each of the arm members being receivable by the corresponding angularly spaced-apart areas of the locking region upon the rotational advancement of the threaded post by at least one of the discrete increments in the threaded opening.

8. The apparatus of claim 5, wherein the locking region comprises a washer including the plurality of angularly spaced-apart raised elements, the washer being embedded in the first member surrounding the threaded opening.

9. The apparatus of claim 1, wherein the threaded post comprises a metal, a plastic, or an elastomeric material.

10. The apparatus of claim 9, wherein the elastomeric material is selected from the group consisting of silicones, siloxanes, nitriles, fluoropolymers, fluoroelastomers, neoprenes, and combinations thereof.

11. The apparatus of claim 9, wherein the elastomeric material is a fluoroelastomer.

12. The apparatus of claim 10, wherein the elastomeric material has a hardness of from about 10 to 100 Shore 00, about 0 to 100 shore A, or about 0 to 80 shore D.

13. The apparatus of claim 1, wherein the first member comprises a moveable door and the second member comprises a stationary compartment.

14. The apparatus of claim 1, wherein said assembly is a structure selected from an overhead bin, an automobile trunk, and body panels of machinery.

15. A method for vibration-reducing vibrations of an assembly comprising a first member including a latch and a second member including a striker, the method comprising:

arranging the first and second members in a closed position relative to each other such that the latch and the striker are engaged with one another;

rotatably advancing a threaded post having arm members extending outwardly therefrom in discrete increments in a threaded opening extending through the first member until a distal portion of the threaded post extending through the first member contacts the second member; and interacting a locking region in the first member surrounding the threaded opening with at least a portion of the arm members of the threaded post upon rotatably advancing the threaded post in the threaded opening by one of the discrete increments so as to at least prevent rotational retraction of the threaded post, the rotational advancement of the threaded post in the threaded opening and subsequent contact with the second member reducing an engagement distance between the latch and the striker with the first and second members in the closed position, and attenuating vibrations between the latch and the striker.

16. The method of claim 15, wherein reducing the engagement distance between the latch and the striker comprises reducing the engagement distance to an allowable design gap.

17. The method of claim 15, wherein the arm members of the threaded post each include a first portion extending radially outward from an end portion of the threaded post, and a second portion extending from a distal end of the first portion and including a protrusion extending outwardly therefrom, and wherein rotatably advancing the threaded post comprises resiliently deforming the second portion of each of the arm members toward each other and rotatably advancing the threaded post in the discrete increments in the threaded opening until the protrusion of each of the arm members interact with corresponding spaced-apart depressions extending about the opening and defined by the locking region.

18. The method of claim 15, wherein the arm members of the threaded post are angularly spaced-apart and extend radially outward from an end portion of the threaded post, and wherein rotatably advancing the threaded post comprises rotatably advancing the threaded post in the discrete increments in the threaded opening until the arm members interact with a plurality of angularly spaced-apart raised elements defined by the locking region and extending longitudinally outward of the opening, and are received by corresponding angularly spaced-apart areas of the locking region between the successive angularly spaced-apart raised elements.

19. An assembly comprising a first member including a latch and a second member including a striker, the latch and the striker being engageable with one another when the first and second members are in a closed position relative to each other, the assembly comprising a vibration-reducing apparatus arranged with respect to the assembly to reduce an engagement distance and to attenuate vibrations between the latch and the striker with the first and second members in the closed position;

wherein the vibration-reducing apparatus comprises:

a threaded post having arm members extending outwardly therefrom, the threaded post being rotatably advanceable in discrete increments in a threaded opening defined by and extending through the first member such that, in the closed position of the first and second members, a distal portion of the threaded post extending through the first member contacts the second member upon rotational advancement of the threaded post in the threaded opening; and a locking region surrounding the threaded opening and being arranged to interact with at least a portion of the arm members of the threaded post upon the rotational advancement of the threaded post in the threaded opening by one of the discrete increments so as to at least prevent rotational retraction of the threaded post, the rotational advancement of the threaded post in the threaded opening and subsequent contact with the second member reducing the engagement distance between the latch and the striker with the first and second members in the closed position, and attenuating the vibrations between the latch and the striker.

* * * * *